US005376028A

United States Patent [19]

Koyanagi

[11] Patent Number: 5,376,028

[45] Date of Patent: Dec. 27, 1994

[54] JET PROPELLED WATERCRAFT

[75] Inventor: Tomoyoshi Koyanagi, Iwata, Japan

[73] Assignee: Yamaha Hatsudoki Kabushiki Kaisha, Iwata, Japan

[21] Appl. No.: 826,961

[22] Filed: Jan. 28, 1992

[30] Foreign Application Priority Data

Feb. 7, 1991 [JP] Japan ..... 3-016324
Feb. 8, 1991 [JP] Japan ..... 3-018042

[51] Int. Cl.[5] ..... B63H 11/11

[52] U.S. Cl. ..... 440/41; 440/38; 440/89

[58] Field of Search ..... 440/38, 40–43, 440/89, 69, 68; 114/270

[56] References Cited

U.S. PATENT DOCUMENTS

| | | | |
|---|---|---|---|
| 2,961,988 | 11/1960 | Wood . | |
| 3,207,116 | 9/1965 | France . | |
| 3,270,699 | 9/1966 | Bush . | |
| 3,422,788 | 1/1969 | Horan, Jr. . | |
| 3,478,712 | 11/1969 | Fox . | |
| 3,802,369 | 4/1974 | Ishimoto | 440/42 X |
| 3,949,700 | 4/1976 | Baroody . | |
| 3,976,026 | 8/1976 | Eastling . | |
| 3,982,497 | 9/1976 | Caron | 114/270 |
| 4,568,291 | 2/1986 | Nelson | 114/246 |
| 4,744,778 | 5/1988 | Porter | 440/89 |
| 4,942,838 | 7/1990 | Boyer et al. | 440/38 X |
| 5,096,961 | 3/1992 | Tazaki et al. | 440/38 |

FOREIGN PATENT DOCUMENTS

| | | | |
|---|---|---|---|
| 650118 | 1/1929 | France . | |
| 1559977 | 3/1969 | France . | |
| 2572052 | 4/1986 | France . | |
| 2732671 | 1/1979 | Germany . | |
| 14789 | 1/1991 | Japan | 440/46 |
| 996103 | 6/1965 | United Kingdom . | |

*Primary Examiner*—Sherman Basinger
*Attorney, Agent, or Firm*—Knobbe, Martens, Olson & Bear

[57] ABSTRACT

A number of embodiments of jet propelled watercraft having one or more jet propulsion units positioned within a tunnel formed on the under side of the hull. The jet propulsion units are pivotal about a transverse horizontally extending axis between a lowered driving position and a raised out of the water position. The tunnel, at least in one embodiment, is defined by an upwardly inclined surface so that the tunnel is higher at its rear than at its front. This elevated portion precludes water from splashing back into the passenger compartment when the watercraft is suddenly decelerated and also provides minimum intrusion into a rear positioned passenger compartment. When the jet propulsion unit is in its lowered position it extends at least in part through the transom of the hull via an opening that is defined by a pair of spaced apart sidewalls that are spaced more closely than the sidewalls which define the tunnel. A dual engine jet propulsion unit watercraft is also disclosed as is an exhaust system which permits the exhaust gases to exist through the transom freely regardless of whether the watercraft is operating in a forward or in a reverse drive mode.

27 Claims, 14 Drawing Sheets

JET PROPELLED WATERCRAFT

BACKGROUND OF THE INVENTION

This invention relates to a jet propelled watercraft and more particularly to an improved arrangement for positioning the jet propulsion unit in a watercraft hull, for employing multiple jet propulsion units and for treating the exhaust gases from the powering internal combustion engine.

There are a number of advantages to the use of so called water jet propulsion units for propelling watercraft. Unlike conventional propeller powered watercraft, a jet propelled watercraft can operate in much shallower bodies of water. In addition, there are a number of other advantages to the use of jet propulsion units. However, it has been proposed to improve the appearance of the watercraft by positioning the jet propulsion unit at least in part in a tunnel formed in the underside of the hull of the watercraft. This gives a very neat appearance and also permits good balance of the watercraft as opposed to transom mounted jet propulsion units.

Where, however, the jet propulsion unit is mounted within the hull of the watercraft there are certain problems which can arise. In the first instance, because of the fact that jet propelled watercraft can operate in shallow bodies of water, frequently the water inlet to the jet propulsion unit may be clogged and it is desirable to access the water inlet so that it can easily be cleared. Of course, this problem is particularly difficult in connection with watercrafts wherein the jet propulsion unit is mounted in a tunnel in the hull of the watercraft.

In addition, during the periods of time when the jet propulsion unit is not employed to power the watercraft or the watercraft is stationery, encrustation of the water inlet and internal components of the jet propulsion unit can be a problem. To avoid the aforenoted problems it has been proposed to provide a watercraft with a jet propulsion unit that can be moved so that its water inlet portion can be raised from a lowered in the water position to an elevated out of the water position. In addition to permitting the water to be drained from the water inlet opening and jet propulsion unit when not in use, such arrangements also permit the cleaning of the water inlet portion while the hull is still floating in a body of water. A number of advantageous embodiments of watercraft and jet propulsion units of this type are disclosed in the co-pending application of Noboru KobayaShi, entitled Water Jet Propulsion Unit, Ser. No. 07,735,154, filed Jul. 22, 1991, now issued as U.S. Pat. No. 5,254,023 which application is a continuation of his earlier application Ser. No. 07,489,361, filed Mar. 6, 1990, now abandoned which applications are assigned to the Assignee hereof.

As is noted in said co-pending application, one way in which the jet propulsion unit may be elevated is to support it for pivotal movement about a transversely extending pivot axis which is disposed forwardly of the jet propulsion unit and adjacent the bulkhead which separates the tunnel in which the jet propulsion unit is mounted from the engine compartment of the watercraft hull. Normally this pivot axis is positioned in a forward location so as to permit the use of a universal joint driving connection between the engine output shaft and the impeller shaft of the jet propulsion units so that the unit can be tilted up without disconnecting the drive thereto. Of course, because of the pivotal movement and the relatively long length of the jet propulsion unit, the discharge end of the jet propulsion unit moves upwardly a greater distance than the forward portion of the jet propulsion unit upon such pivotal movement. It has been heretofore the practice to provide a tunnel that has substantially uniform height throughout its length and this means that the tunnel can intrude into the remainder of the watercraft hull.

It is, therefore, a principal object of this invention to provide an improved watercraft hull and jet propulsion unit arrangement wherein the jet propulsion unit is supported for pivotal movement about a transverse axis and yet does not provide an undue intrusion into the interior of the hull.

For a variety of reasons, it is desirable to provide a relatively low transom for the hull of a watercraft. However, when a low transom is provided there are some problems that are encountered when the watercraft is rapidly decelerated from a high speed condition. The wake, particularly around the propulsion unit, can then move forward and overflow the rear of the transom if it is too low.

It is, therefore, a still further object of this invention to provide an improved hull and transom construction for a jet propelled watercraft wherein the rear of the transom is designed so as to prevent water from passing back into the hull during sudden decelerations without adversely effecting the rear view from the watercraft.

As has been previously noted, there are substantial advantageous to positioning the jet propulsion unit of a watercraft in a tunnel positioned on the underside of the watercraft hull. However, if the jet propulsion unit discharge nozzle is also positioned completely within this tunnel, certain problems in connection with interference from the discharge, particularly during steering movement of the discharge nozzle, can be encountered.

It is, therefore, a still further object of this invention to provide an improved jet propelled watercraft wherein the jet propulsion unit is mounted within a tunnel in the hull of the watercraft wherein the mounting arrangement is such that the discharge from the discharge nozzle is not obstructed by the sidewalls of the tunnel.

It is a still further object of this invention to provide an improved hull arrangement for a jet propelled watercraft wherein the discharge from the discharge nozzle of the jet propulsion unit is unobstructed but wherein the hull has side portions that are closely positioned to this discharge nozzle.

In connection with the use of jet propulsion units, it is the normal practice to provide a powering internal combustion engine for driving the jet propulsion unit. As is typical with watercraft practice, the exhaust from the internal combustion engine is discharged back into the body of water in which the watercraft is operating to provide some partial silencing. However, when this is done with a jet propulsion unit the exhaust discharge may actually be released in the tunnel where the jet propulsion unit is positioned. Although this has certain advantages when traveling in a forward direction, if the watercraft is operated in reverse the exhaust gases will tend to collect in the tunnel and not be discharged therefrom. This can cause not only contamination of the hull but other problems.

It is, therefore, a further object of this invention to provide an improved arrangement for discharging the exhaust gases from a jet propelled watercraft in such a way that the exhaust gases can flow freely regardless of whether the watercraft is operating in a forward or reverse drive mode.

SUMMARY OF THE INVENTION

A first feature of this invention is adapted to be embodied in a watercraft having a hull defining a tunnel at the rear end thereof. A jet propulsion unit is supported within the hull and least in part in the tunnel for pivotal movement about a horizontal transverse axis between a lower driving position and a raised storage position. The tunnel is defined at its upper extremity by an upper surface which is higher above the bottom of the hull at the rear end thereof than at the front end thereof.

Another feature of the invention is adapted to be embodied in a watercraft having a hull defining a transom and a tunnel opening through the rear of the transom. A jet propulsion unit is supported within the hull at least in part in the tunnel for powering the watercraft. The transom has a substantially greater height above the tunnel than it does on the sides of the tunnel so as to preclude water from intruding back into the watercraft upon sudden decelerations.

Yet another feature of the invention is adapted to be embodied in a watercraft having a hull defining a tunnel at the rear end thereof by spaced apart sidewalls. A jet propulsion unit is supported within the hull at least in part in the tunnel for powering the watercraft. The jet propulsion unit has a discharged end which extends beyond the rear of the tunnel.

Yet a further feature of the invention is also adapted to be embodied in a watercraft having a hull defining a tunnel by spaced apart sidewalls at the rear end of the hull. A jet propulsion unit is supported within the hull and at least in part in the tunnel for powering the watercraft. The tunnel sidewalls have rear portions that are disposed more closely than the sidewalls and contiguous to a discharge nozzle of the jet propulsion unit.

Yet another feature of the invention is adapted to be embodied in a jet propelled watercraft having a hull and a jet propulsion unit supported by the hull for powering the watercraft. An internal combustion engine is supported within the hull for driving the jet propulsion unit and has an exhaust system including an exhaust pipe that exists through the rear portion of the hull. The rear portion of the hull where the exhaust pipe exists is formed with a side relief so that exhaust gases may flow through this side relief toward the front of the hull when the watercraft is operating in a reverse mode.

DETAILED DESCRIPTION OF THE PREFERRED EMBODIMENTS OF THE INVENTION

Figure 1:
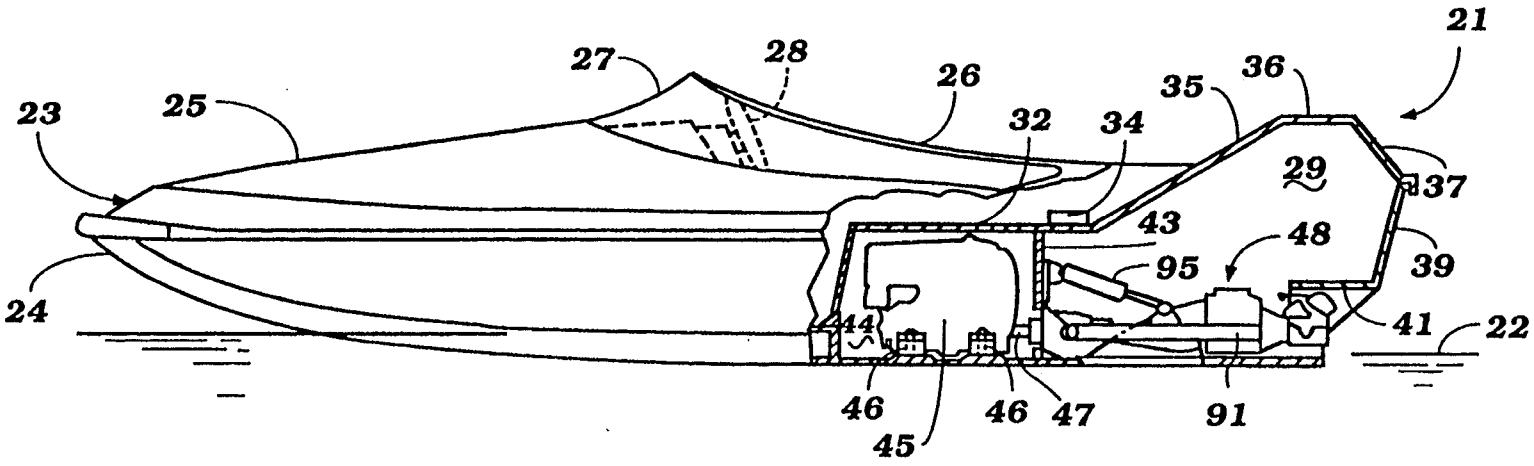
FIG. 1 is a side elevational view of a jet propelled watercraft constructed in accordance with a first embodiment of the invention, with a portion broken away so as to more clearly show the jet propulsion unit and powering internal combustion engine.
Figure 2:
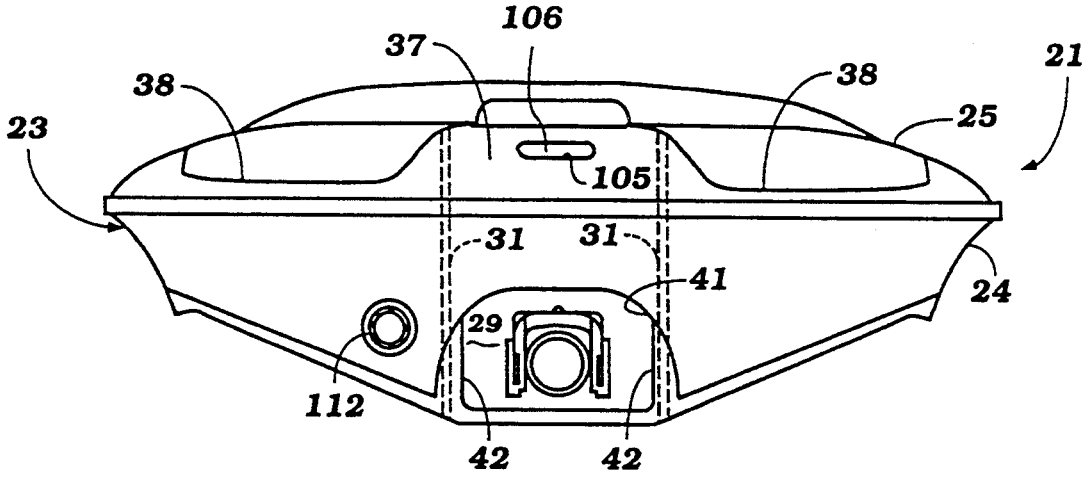
FIG. 2 is a rear elevational view of the watercraft.

Referring first to the embodiment of FIGS. 1 through 4 and initially to FIGS. 1 and 2, a jet propelled watercraft constructed in accordance with this embodiment of the invention is identified generally by the reference numeral 21 and depicted in FIG. 1 as being afloat in a body of water 22. The position shown in the body of water in FIG. 2 is the position assumed by the watercraft when travelling at speed.

Watercraft 21 is comprised of a hull assembly, indicated generally by the reference numeral 23 which consists primarily of a lower part 24 and an upper deck part 25. The hull parts 24 and 25 may be formed from a suitable material such as a molded fiberglass reinforced resin. The rear portion of the hull has a generally upwardly open rider's area 26 that is adapted to contain a plurality of seats for accommodating the operator and passengers of the watercraft. A windshield 27 is positioned forwardly of the rider's area 26 and a control panel and steering wheel 28 is positioned in this area ahead of one of the seats so as to accommodate the operator of the watercraft 21.

A tunnel, indicated generally by the reference numeral 29 is formed in the rear of the hull 23 centrally thereof and defined in part by a pair of vertically upstanding sidewalls 31 which are formed integrally with the lower hull portion or which may be separate members affixed to it. The upper surface of the tunnel 29 is defined by a horizontally extending portion 32 (FIGS. 1 and 3) which extends at the rear portion of the rider's area 26 and rearwardly. An access opening 33 is formed in this wall and is closed by a removable closure 34 for a reason to be described. Rearwardly of the opening 33 and closure 34, the wall 32 is met by an angularly inclined wall 35 which extends upwardly and rearwardly toward the back of the watercraft 21. This wall 35 merges with a horizontally extending wall 36 that is disposed at a substantially higher level than the wall 32 and which meets a downwardly sloping transom portion 37 formed by the deck part 25. As may be noted from the rear view of FIG. 2, the portion 37 has a substantially greater height than the adjacent side portions 38 of the transom of the watercraft. The reason for this will be described.

The lower hull portion 24 has a transom portion 39 which merges with the transom portion formed by the deck part 25. The rear of the tunnel 29 is formed with an arcuate opening 41 that extends through the lower portion of the hull transom 39 and which is defined by a pair of sidewalls 42 that are disposed more closely adjacent each other than the sidewalls 31, for a reason to be described.

The forward portion of the tunnel 29 is defined by a vertically extending bulkhead 43 which divides the tunnel 29 from an engine compartment 44. The upper portion of the engine compartment 44 is enclosed by an extension of the wall 32 and extends into the passenger compartment 26. A powering internal combustion engine 45 is supported within the engine compartment 44 on vibration isolating engine mounts 46. The engine 45 may be of any known type and drives an output shaft 47 which extends through the bulkhead 43. This engine output shaft 47 is coupled, in a manner to be described, to a jet propulsion unit, indicated generally by the reference numeral 48 and which is mounted in a manner to be described within the tunnel 29. Specifically, the construction and mounting of the jet propulsion unit 48 is substantially the same as that illustrated and described in the co-pending application entitled Water Jet Propulsion Boat, Ser. No. 07/680,709, filed Apr. 4, 1991, now U.S. Pat. No. 5,151,057 in the name of Noboru Kobayashi and assigned to the Assignee hereof, the disclosure of which is incorporated herein by reference.

Basically, the jet propulsion unit includes a water inlet portion 49 having a downwardly facing water inlet opening 51 which draws water from the body of water 22, in a manner to be described. The water inlet opening 49 is defined by a peripheral flange 52 to which a screen or grate 53 is affixed with an interposed resilient seal 54 so as to preclude large objects from being drawn into the water inlet opening 51.

An impeller housing 55 is affixed to the water inlet portion 49 and specifically to a flange 56 thereof by means of spacer plates and gaskets 57 and threaded fasteners. The impeller housing 55, in turn, has a downstream end in which a plurality of straightening vanes 58 are provided. These straightening vanes 58 extend from a nacelle 59 that contains bearings 61 for journaling the rear end of an impeller shaft 62. The impeller shaft 62 has affixed to it an impeller 63 which lies within the impeller housing 55 and which draws water through the water inlet opening 51 and discharges it to a discharge nozzle 64. The discharge nozzle 64 is affixed to a split support ring comprised of member 65 and 66 which carry a bushing 67 that rotatably journals the impeller housing 55, for a reason to be described.

A steering nozzle 68 is supported for steering movement about a vertically extending steering axis at the end of the discharge nozzle 64 by means of a pair of aligned pivot pins 69. The steering nozzle 68 is connected to the steering wheel 28 by means of a bowden wire actuator 71 for steering of the steering nozzle 68 and the watercraft 21 in a well known manner.

Figure 3:
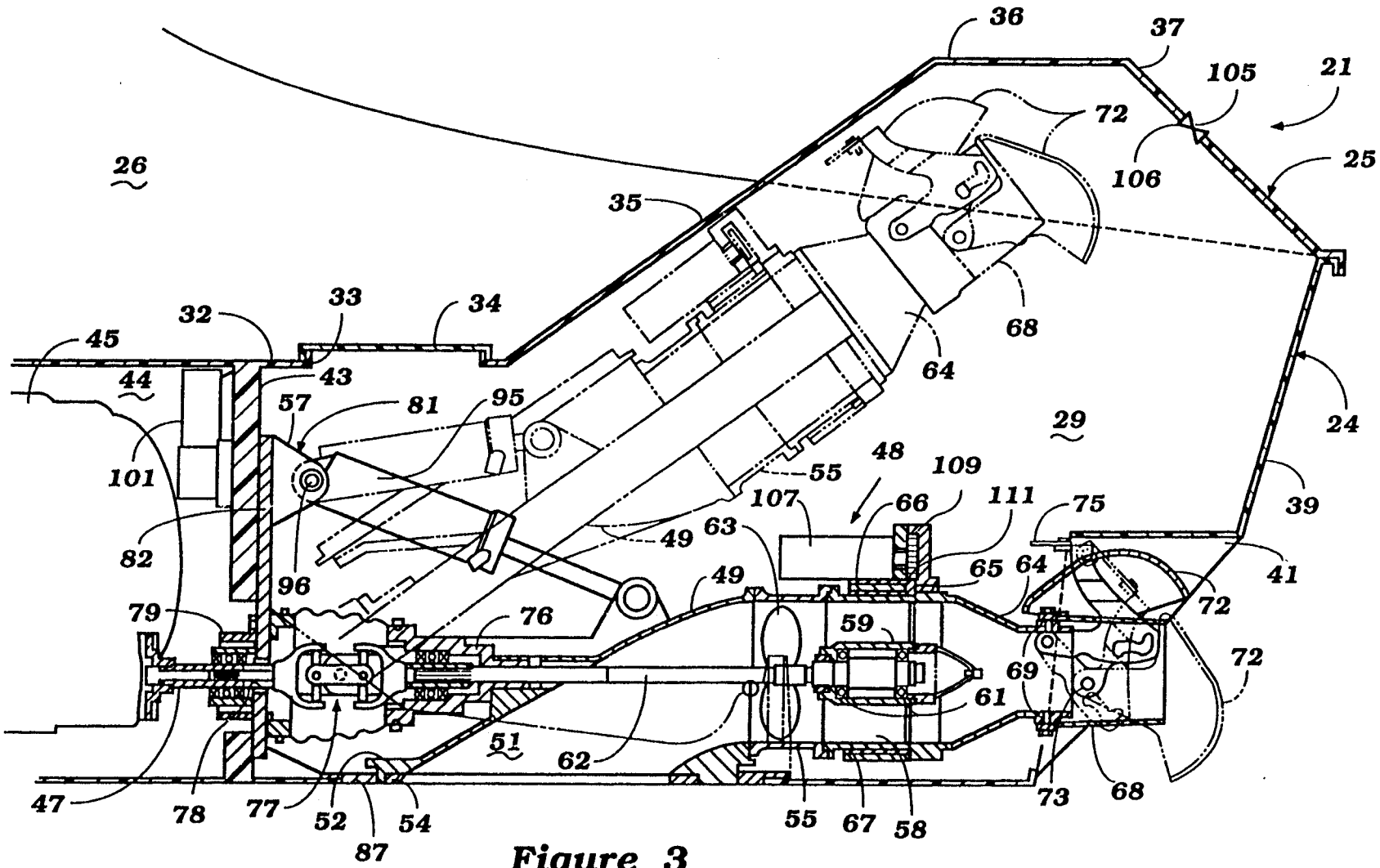
FIG. 3 is an enlarged cross sectional view taken through the tunnel of the watercraft and generally along the same plane as FIG. 2, with portions of the jet propulsion unit shown in section.
Figure 4:
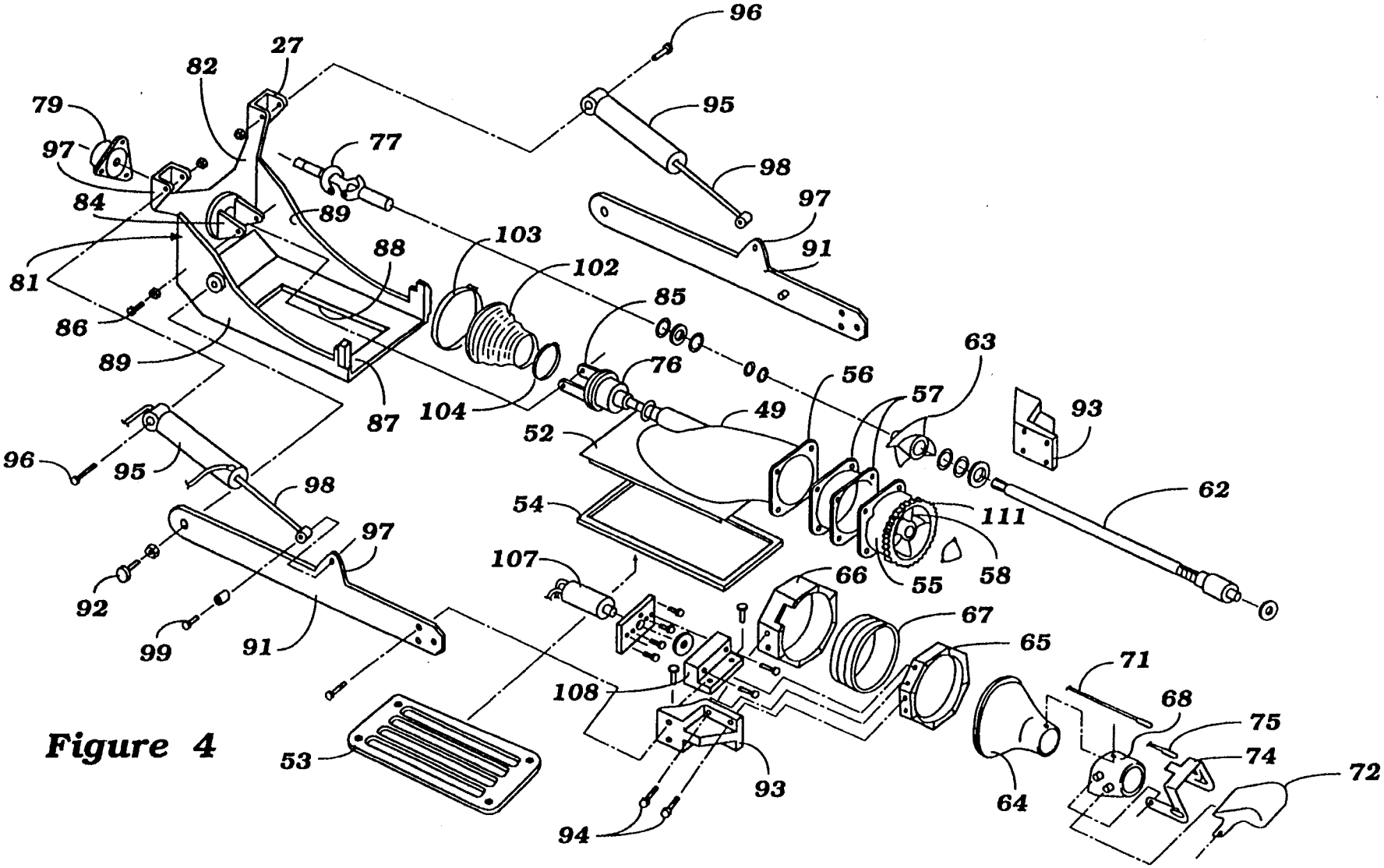
FIG. 4 is an exploded perspective view showing the components of the jet propulsion unit.

A reverse thrust bucket 72 is pivotally supported on the steering nozzle 68 by means of a pair of spaced apart pivot pins 73 for movement between a retracted forward drive position as shown in solid lines in FIG. 3 and a lowered reverse thrust generating position as shown in phantom lines in this figure. An actuating lever 74 is mounted on the steering nozzle 68 and has a pin and slot connection with the reverse thrust bucket 72 for moving it between these positions upon operator control. A bowden wire cable 75 is connected to the actuating lever 74 for operating it and the reverse thrust bucket 72 in a manner as described in the aforenoted application co-pending application, Ser. No. 07/680,709 now U.S. Pat. No. 5,151,057.

The impeller shaft 62 extends forwardly through the water inlet housing 49 and is journaled at the forward end thereof by means of a pilot bushing assembly 76. Adjacent the pilot bushing assembly 76 there is provided a universal joint assembly, indicated generally by the reference numeral 77 which has a splined connection to the engine output shaft 47. The output shaft 47 extends through an opening 78 formed in the bulkhead 43 and a bearing support 79 is affixed on the engine compartments side of the bulkhead 43 for journaling the output shaft 47.

The jet propulsion unit 48 is supported within the tunnel 29 as a unitary assembly upon a cradle, indicated generally by the reference numeral 81. The cradle 81 has a vertically extending front wall 82 that is affixed in a suitable manner to the bulkhead 43 and which has an opening defined by a trunnion portion 84 through which the universal joint 77 extends. The bearing pilot portion 76 has a pair of forwardly extending arms 85 which are pivotally connected to the trunnion portion 84 by pivot pins 86. This defines a horizontally extending pivot axis which is aligned with the universal joint 77 so as to accommodate tilting movement of the jet propulsion unit 45 from the normal driving position as shown in solid lines in FIG. 3 to an elevated out of the water storage position as shown in phantom lines. The way in which this pivotal movement is accomplished will be described later.

The supporting cradle 81 has a horizontally extending portion 87 in which a water inlet opening 88 is formed. The screen 53 is adapted to lie in the plane of the opening 88 and may be sealingly engaged with it when in the lowered position so as to provide a good seal around the water inlet opening 51 and, accordingly, high efficiency of the jet propulsion unit. The cradle portion 87 in effect forms a closure for the lower end of the front portion of the tunnel 29 and, accordingly, spans the bulkheads 31 or at least a substantial portion of them. Alternatively, other lower members of the hull may complete this closure.

The lower portion 87 is defined between a pair of vertically extending side portions 89 each of which pivotally support the leading ends of a pair of support arms 91 by means of pivot pins 92. The pivot axis defined by the pivot pins 92 is aligned with the pivot axis defined by the pivot pins 86. The rear ends of the support arms 91 are affixed to support blocks 93 by means of threaded fasteners 94. The support blocks 93 are, in turn, affixed to the support ring 66 and 65 so as to provide support for the impeller housing 55 of the jet propulsion unit 48 and to carry to the weight of the rear portion of this assemblage.

A pair of hydraulically operated cylinders 95 are pivotally connected by means of pivot pins 96 to a pair of trunnions 97 formed at the upper end of the supporting carriage 81 and specifically its portion 82. The support arms 91 have upstanding projections 97 to which the piston rods 98 of the hydraulic motors 95 are pivotally connected by means of pivot pins 99.

The hydraulic motors 95 are supplied with fluid under pressure by a pump and motor assembly 101 supported on the front of the bulkhead 43 and connected to the motor 95 through suitable hydraulic lines. Upon energization of the fluid motors 95, the entire jet propulsion unit 48 will be pivoted about the pivot axis defined by the universal joint 77 and pivot pins 86 and 92 from the lowered position to the raised position. In this raised position, the water inlet portion 51 will be above the body of water in which the watercraft is operating so that water can drain out of it and avoid the likelihood of encrustation being formed on the internal components of the jet propulsion unit.

An elastic boot 102 encircles the universal joint 77 is affixed to the trunnion 84 by means of a first clamp 103 and to the pilot portion 76 by a second clamp 104. As a result, the mechanical components of the jet propulsion unit 48 will be sealed from the water.

It should be noted that the inclination of the wall 35 which defines the tunnel 29 permits a great degree of elevation of the jet propulsion unit 48 without seriously encroaching upon the area of the passenger compartment 26. This is possible because the rear portion of the tunnel 29 defined by the upper wall 36 is substantially higher than the front portion as defined by the wall 32. This rearward position of the elevated walls 35 and 36 provides minimum intrusion in the passenger compartment 26, as aforenoted.

It should be noted that in the lowered position of the jet propulsion unit 48 the steering nozzle 68 extends through the recess 41 in the rear of the transom so that the water discharged from the steering nozzle 68 will not cause turbulence within the tunnel 29 and so that maximum steering effect can be gained. However, when the jet propulsion unit 48 is elevated through its pivotal movement to the phantom line position, the entire jet propulsion unit will be contained within the tunnel 29.

Also, because of the raised central portion caused by the walls 36 and 37 the center portion of the transom above the discharge nozzle 68 will be higher than the sides. Hence, if the watercraft is suddenly slowed any water which may splash forwardly will not enter the passenger compartment 26. The low side portions, however, assure good visibility.

One or more vent openings 105 are formed in the transom portion 37 and may be sealed by a flap type check valve 106. This will permit air to enter and exit the tunnel 29 as the water level raises and lowers therein so as to avoid the generation of any air pressure variations that could affect lifting force on the rear of the hull due to water level changes due to sudden changes in speed. Also, this venting will permit any gases which may enter the tunnel 29 to be easily vented.

In addition to the pivotal movement as aforedescribed, the water inlet portion 49 and impeller housing 55 may be rotated from a downwardly facing position as shown in the solid lines in FIG. 3 to an upwardly facing position as shown in the phantom lines in this figure so that the screen 53 and water inlet opening 51 may be easily accessed through the opening 33 in the hull. For this purpose, there is provided a reversible electric motor 107 that is mounted on the support ring 66 by means of a supporting bracket 108. The motor 107 drives a drive gear 109 which is enmeshed with an integral gear 111 formed on the impeller housing 55. When the motor 107 is actuated, the inlet portion 49 and impeller portion 55 will rotate in the bushing 67 between the lowered and raised position. This construction is as described in aforenoted co-pending application Ser. No. 07/680,709 now U.S. Pat. No. 5,157,057.

Figure 15:
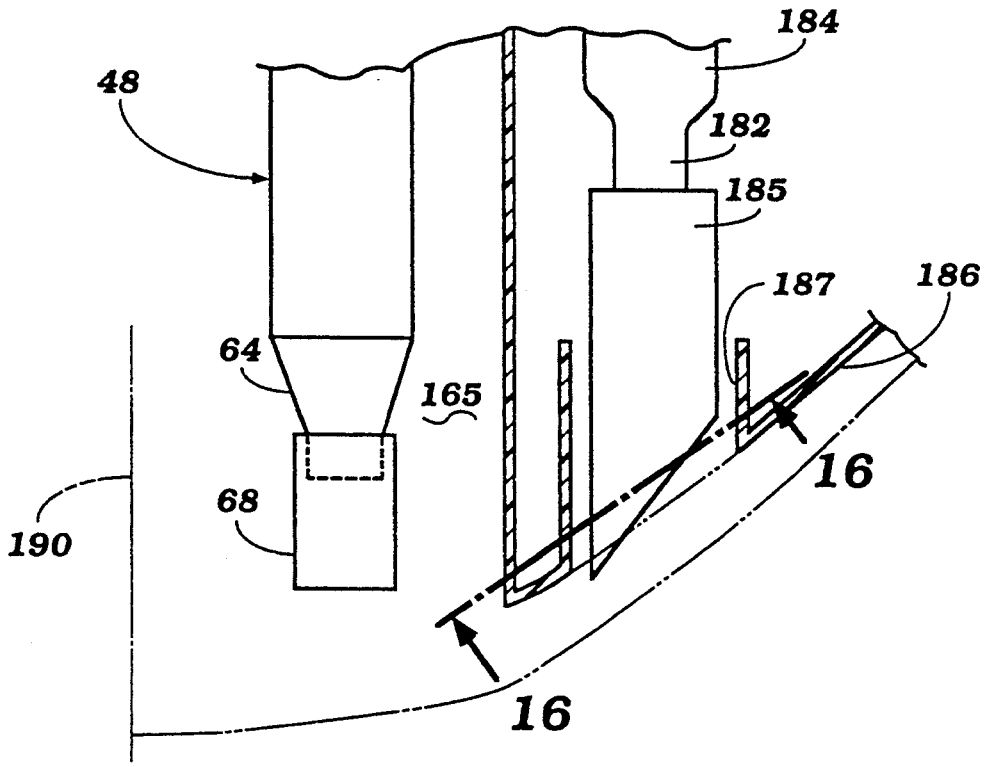
FIG. 15 is an enlarged cross sectional view taken along the line 15—15 of FIG. 13.
Figure 16:
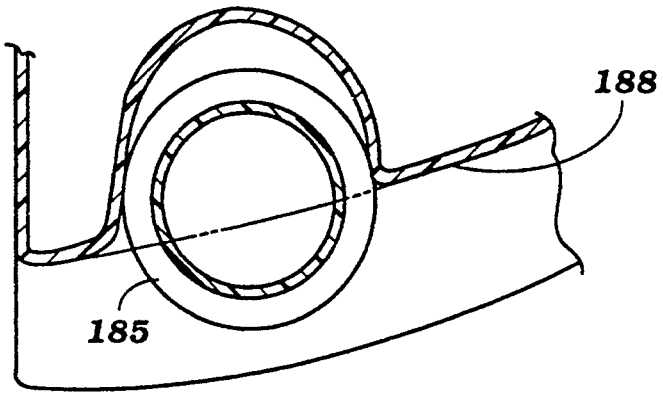
FIG. 16 is a cross sectional view taken along the line 16—16 of FIG. 15.

The powering internal combustion engine 45 is provided with an exhaust system which terminates in a tail pipe 112 that extends through a side of the transom adjacent the tunnel opening 41. This exhaust pipe is blended into the hull in a manner which will be described in conjunction with the embodiment of FIGS. 5 through 20 and specifically as shown in FIGS. 15 and 16 thereof so as to permit the smooth exit of the exhaust gases regardless of whether the watercraft 21 is traveling in a forward or reverse direction without causing erosion of the hull or contamination of it. The details of that construction will become apparent as the next embodiment is described.

Referring now in detail to the embodiment of FIGS. 5 through 20, a jet propelled watercraft constructed in accordance with this embodiment of the invention is identified generally by the reference numeral 151. The watercraft 151 like the watercraft 21 of the previously described embodiment has a hull, indicated generally by the reference numeral 152 and which is comprised of a lower hull portion 153 and an upper deck portion 154 which are formed from a suitable material such as a molded fiberglass resin.

Figure 5:
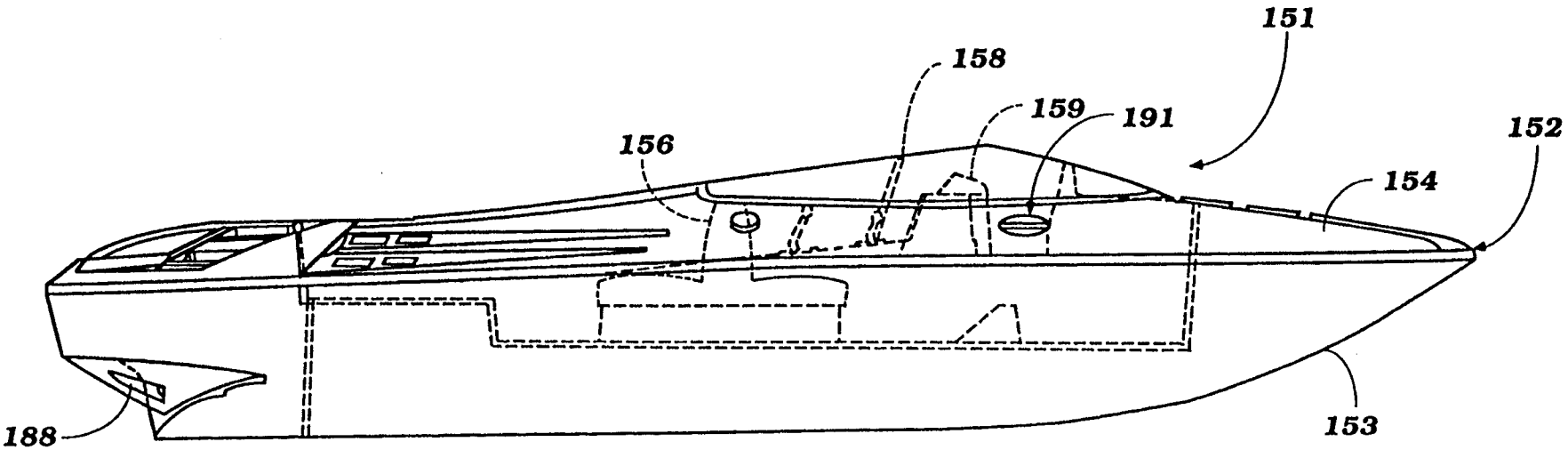
FIG. 5 is a side elevational view, in part similar to FIG. 1, showing a watercraft constructed in accordance with another embodiment of the invention.
Figure 6:
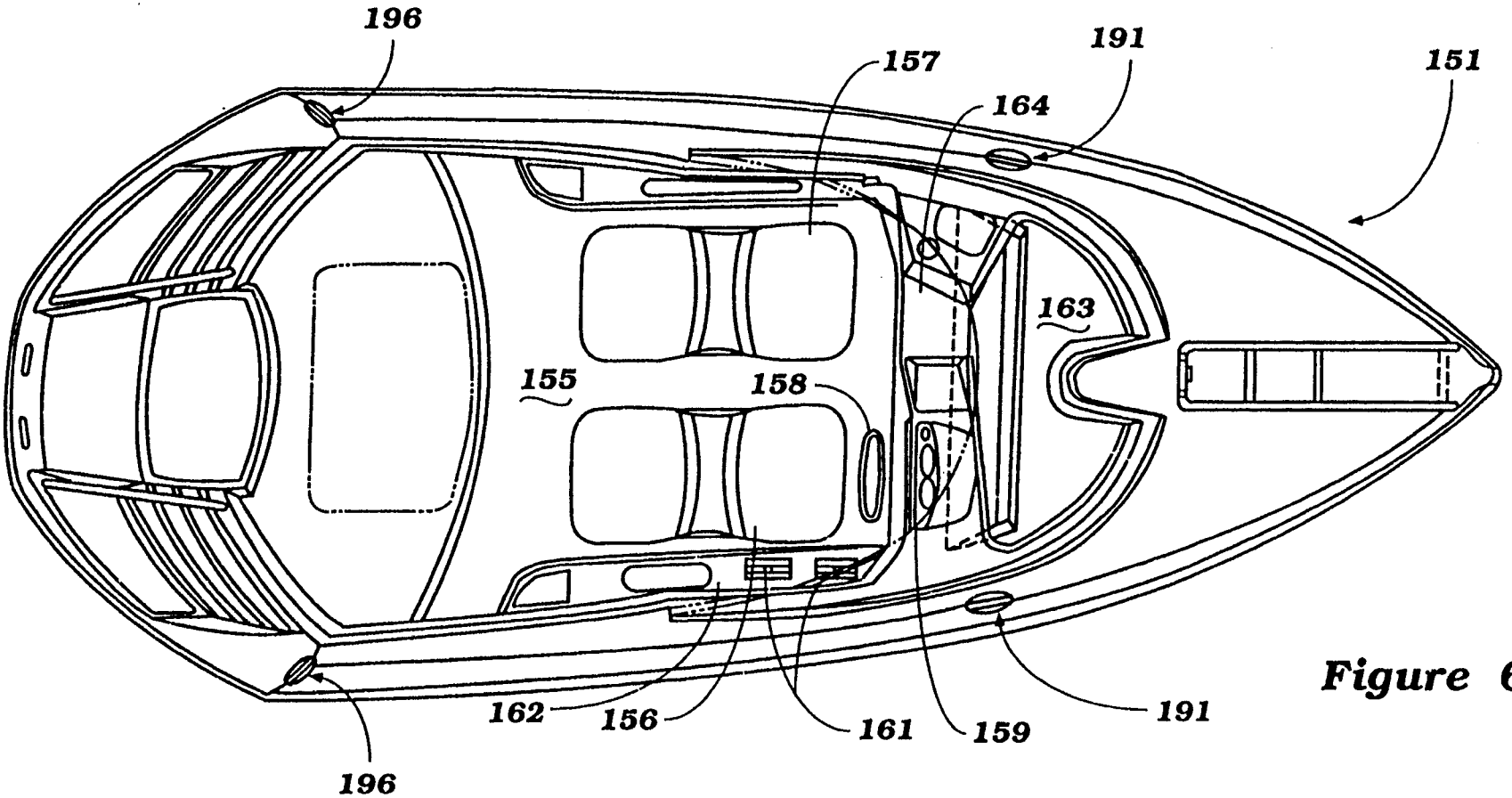
FIG. 6 is a top plan view of the watercraft.
Figure 7:
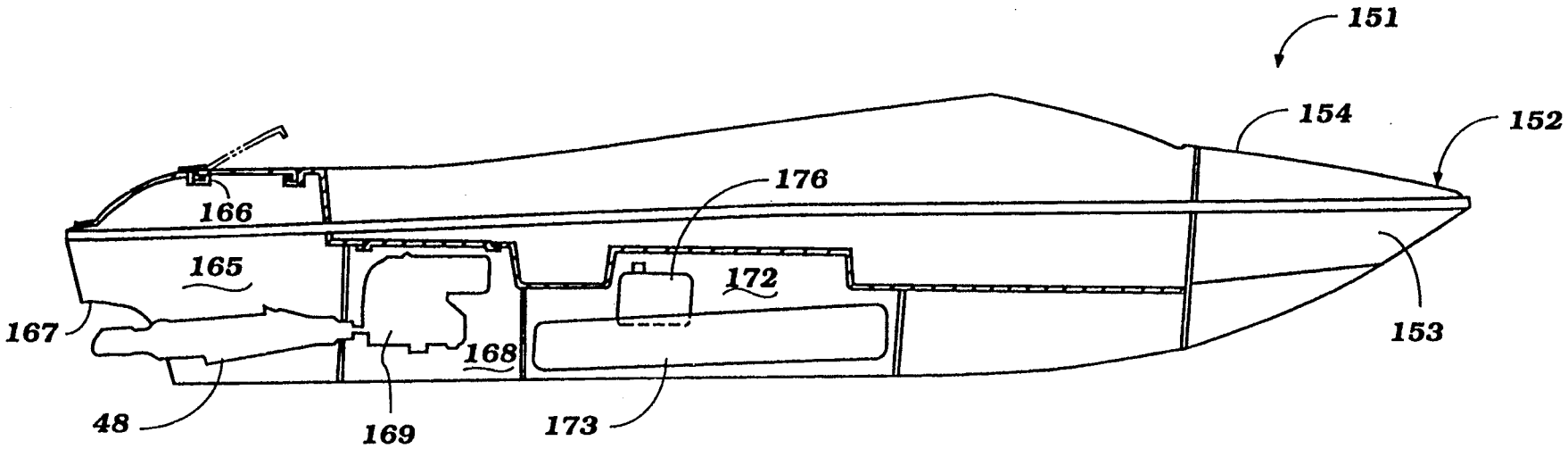
FIG. 7 is a side elevational view of the watercraft, with portions broken away so as to more clearly show the internal construction.
Figure 8:
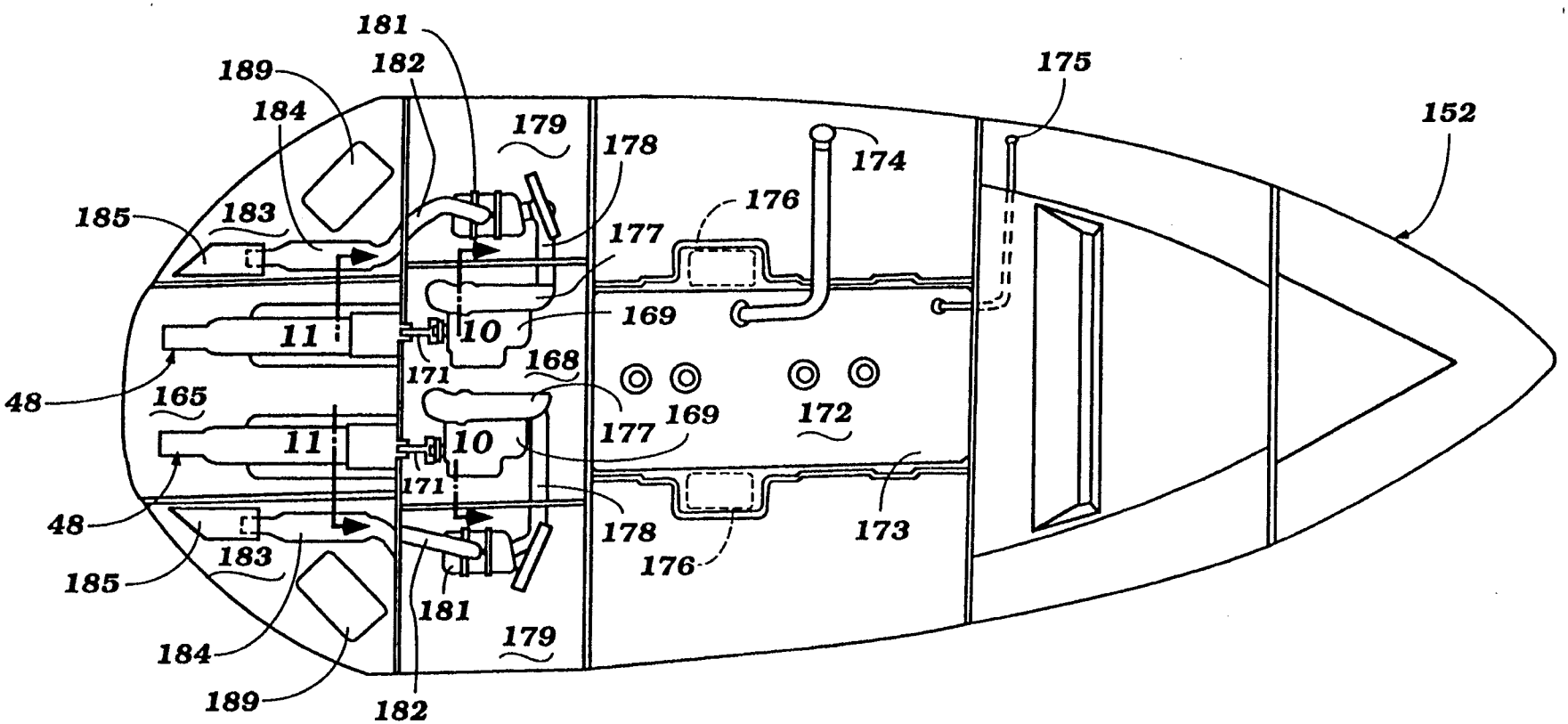
FIG. 8 is a top plan view with portions broken away to show the layout of the components depicted in FIG. 7.

A passenger compartment, indicated generally by the reference numeral 155 and shown in most detail in FIGS. 5 and 6 is positioned at the rear end of the hull 152 although the passenger compartment 155 in this embodiment extends considerably further forward than that of the previously described embodiment. In this embodiment, the passenger compartment 155 supports a pair of tandem seats 156 and 157 each of which provides a single forwardly facing seat and a single rearwardly facing seat. The forward portion of the seat 156 accommodates an operator and a steering wheel 158 and dash panel 159 is provided in front of the seat 156 for the various controls for the watercraft. In addition, throttle and reverse thrust bucket controls 161 for the two jet propulsion units, to be described, are positioned adjacent the side of the seat 156 on a further control panel 162.

Figure 14:
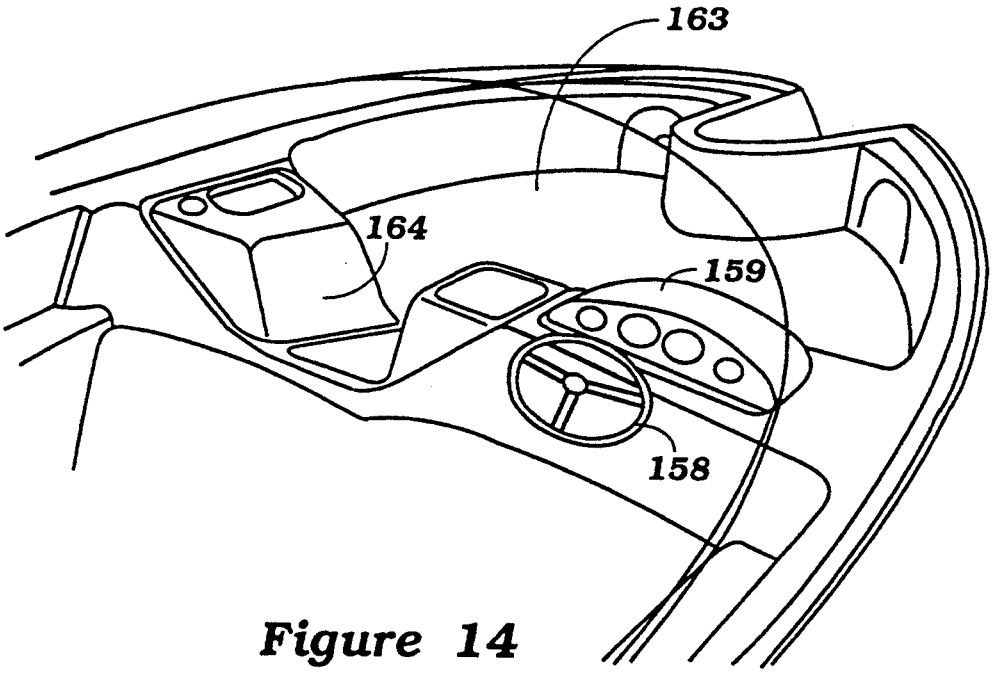
FIG. 14 is an enlarged perspective view taken from above and the rear showing the front portion of the hull and rider's compartment of this embodiment.

As may be best seen in FIGS. 6 and 14, there is provided a forward passenger area 163 that is accessible through a recess 164 formed between the seats 156 and 157 so as to accommodate transition of passengers from the compartment 155 to the portion 163.

Referring now primarily to FIGS. 7 through 11, the lower hull portion 153 forms a tunnel 165 at the rear end thereof which tunnel is wider than the tunnel of the previously described embodiment but which carries a pair of jet propulsion units each of which has the same construction as the jet propulsion unit of the previously described embodiment and, therefore, these jet propulsion units have been indicated by the same reference numerals 48. The jet propulsion units 48 are each moveable about transverse pivot axis between a lowered operative position and a raised storage position and their inlet and impeller portions are rotatable about a longitudinal axis which is coincident with the axis of the impeller shaft to raise the water inlet openings to an upwardly facing position for servicing through an access opening 166 formed in the upper portion of the deck 154 rearwardly of the passenger compartment 155.

Like the previously described embodiment, the transom of the hull and specifically the lower hull portion 153 is provided with a cutout area 167 for passing the discharge nozzles of the jet propulsion units 48 and their steering nozzles. However, when the jet propulsion units 48 are pivoted up they will be contained completely within the tunnel 167. Again, the tunnel is configured so that it will be raised at the center of the hull so as to provide anti-splash back protection but not as steeply as the previously described embodiment. However, an arrangement as in that embodiment may also be employed in this embodiment.

Forwardly of the tunnel 165, the hull is formed with an engine compartment 168 in which a pair of internal combustion engines 169 are supported in side by side fashion. The engines 169 have their output shafts 171 connected to the respective jet propulsion unit 48 and specifically their impeller shafts in a manner previously described including a universal joint which permits the pivotal movement of the jet propulsion units about the transverse axis.

A further compartment 172 is formed forwardly of the engine compartment 168 and contains a fuel tank 173 for the two engines 169 which has a fill nozzle 174 and a vent pipe 175. The fuel tank 172 is disposed centrally of the hull 152 so as to maintain a good fore and aft balance and also is disposed on the longitudinal center line of the hull 152 so as to avoid any possible side to side unbalance. A pair of oil tanks 176 for each of the engines 169 are disposed in side by side relationship to the fuel tank 173 in the recess 172 also to maintain good fore and aft and side by side balance.

The engines 169 each have exhaust manifolds 177 that receive the exhaust gases from the engines 169 and which also receive coolant which has been drawn through the body of water in which the watercraft 152 is operating. The exhaust manifolds 177 discharge the exhaust gases through respective exhaust pipes 178 that extend transversely outwardly from the engine compartment 168 and which enter into further compartments 179 each formed on a respective side of the engine compartment 168. By separating the exhaust gases into two separate compartments, effective cooling and silencing may be achieved and the temperature of the engine compartment 168 will be maintained at a low temperature.

Figure 12:
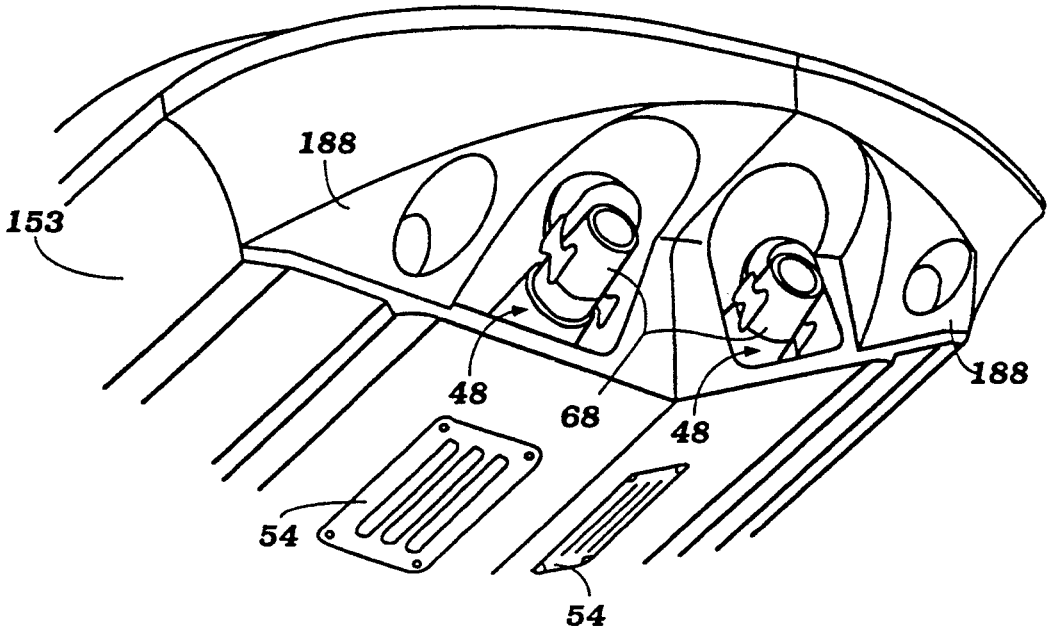
FIG. 12 is an enlarged rear perspective view taken from below and shows the rear portion of the hull of the watercraft and its relation to the jet propulsion units and the exhaust discharge from the engine of this embodiment.
Figure 13:
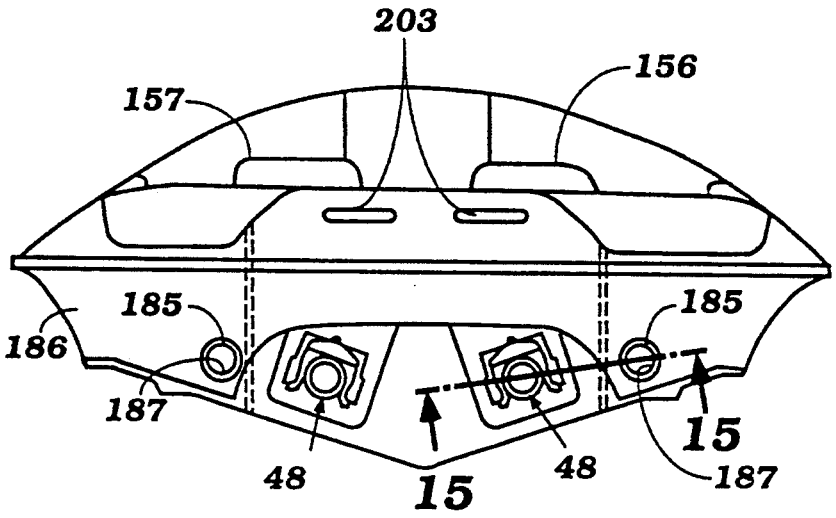
FIG. 13 is a rear elevational view of the watercraft of this embodiment.

There are provided in the compartments 179 combined water trap and water separator devices 181 which also function to silence the exhaust gases emanating from the engines 169. The exhaust gases then flow from the silencing and separators 181 to exhaust pipes 182 that extend into further chambers 183 formed in the hull 152 to the rear of the compartments 179 and on the sides of the tunnel 165. The tailpipes 182 have further muffler sections 184 formed therein which lie within the compartments 183 and the exhaust gases are then discharged through extractor sections 185 which cooperate with the hull 152 and specifically the lower portion 153 in a manner as best seen in FIGS. 12, 15 and 16.

It should be noted that the hull lower portion transom, indicated generally by the reference numeral 186 is provided with a pair of enlarged openings 187 through which the extractors 185 extend. There is a slight gap in this area and the rear of the transom 183 is formed with a recessed area 188 This recessed area 188 is disposed at an angle to the rear of the watercraft and the recessed area 188 diverges outwardly in a forward direction relative to a longitudinal center line 190 of the watercraft as shown in FIG. 15 toward the sides of the hull so that it blends into the remainder of the hull but which will let the exhaust gases flow forwardly when the watercraft is operating in a reverse direction freely and without obstruction. As a result, the watercraft 151 can operate with good exhaust gas efficiency even in the reverse mode. In addition, there will be no erosion of the body of the watercraft caused by the exhaust flow.

Contained within the compartments 183 are batteries 189 which are charged by alternators or generators driven by the engines 169 which can provide power for both the ignition system of the engines 169 and also for any electrical accessories carried by the watercraft 151.

Figure 17:
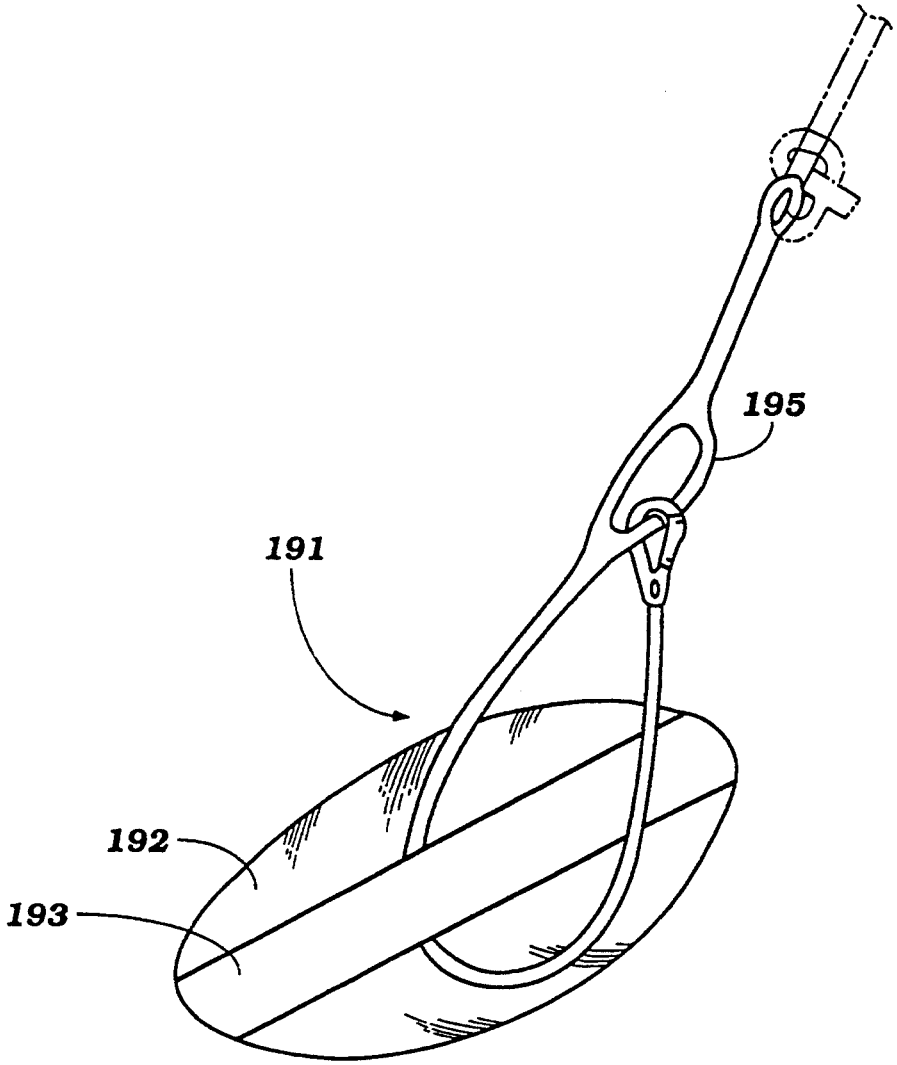
FIG. 17 is an enlarged perspective view showing one of the tie-downs for the watercraft of this embodiment.
Figure 18:
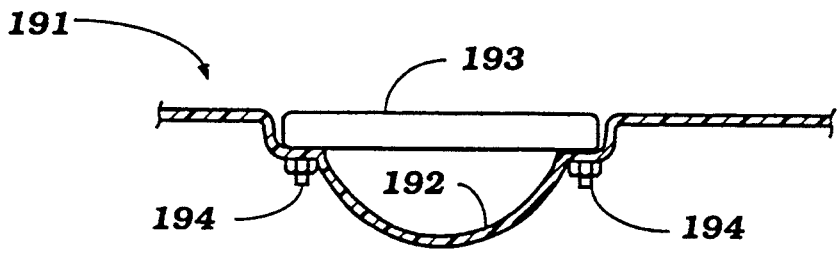
FIG. 18 is a cross sectional view taken through the tie-down and showing its construction.

There are provided on various portions of the hull 152 tiedown assemblies, one type of which is identified generally by the reference numeral 191 and which is shown in most detail in FIGS. 5, 17 and 18. The tiedowns 191 are comprised of recesses 192 formed in the appropriate hull section, in this case the deck 154 and across which a strap like member 193 is affixed by fasteners 194 so as to receive a respective tie or anchor rope 195.

Figure 19:
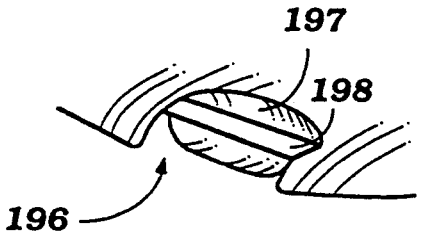
FIG. 19 is a perspective view showing another form of tie-down.
Figure 20:
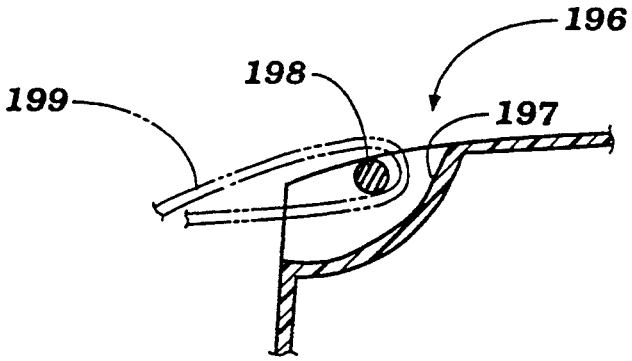
FIG. 20 is a cross sectional view of the tie-down shown in FIG. 19.

Another type of tiedown which may be employed with the watercraft 151 is illustrated in FIGS. 19 and 20. This tiedown is indicated generally by the reference numeral 196 and is comprised of a recess 197 formed in a peripheral portion of the hull and across which a tiebar 198 is affixed in a suitable manner so as to receive a rope or other tie device 199.

Figure 9:
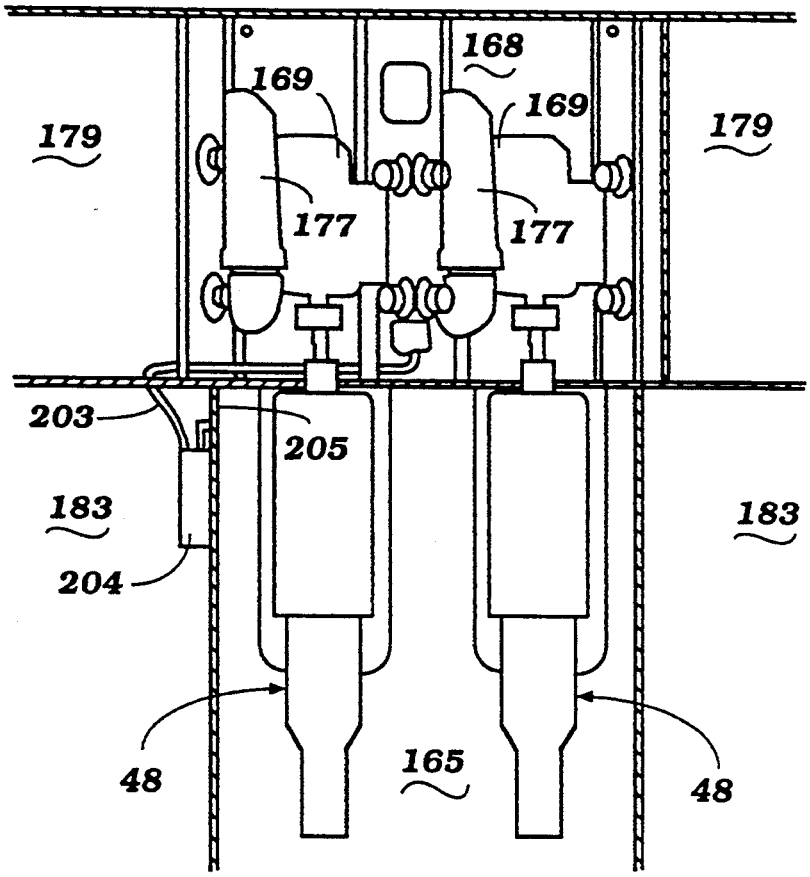
FIG. 9 is a further enlarged top plan view showing the relationship of the engines and jet propulsion units and is taken along a plane the same as the plane of FIG. 8.
Figure 10:
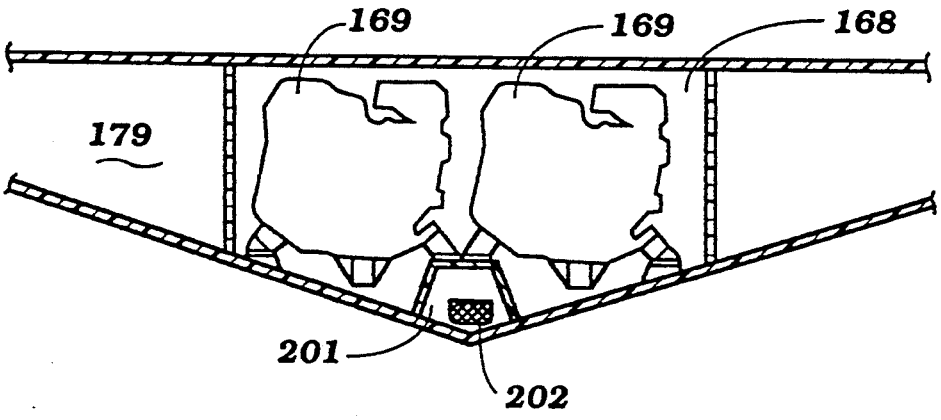
FIG. 10 is a cross sectional view taken along the line 10—10 in FIG. 9 and showing the locations of the driving engines in the engine compartment.
Figure 11:
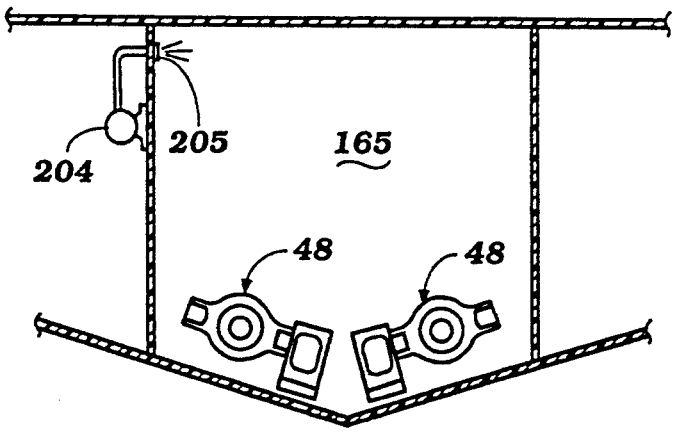
FIG. 11 is a cross sectional view taken along the line 11—11 of FIG. 10 and shows the tunnel and jet propulsion units positioned therein.

Engine compartment 168 is provided with a bilge 201 in which a strainer 202 is provided at the end of a conduit 203 (FIGS. 9 and 10) which leads to a bilge pump 204 (FIGS. 9 and 11). The bilge pump 204 pumps the bilge water and discharges it through an outlet 205 into the tunnel 165 for return to the body of water in which the watercraft is operating.

Like the previously described embodiment, the tunnel 165 is provided with one or more air vents 206 (FIG. 13) through which air can be expelled or drawn depending upon how the water level changes within the tunnel 165 so as to permit water to freely flow in and out of the tunnel without causing undue lifting action to the rear of the hull 152.

It should be readily apparent from the foregoing description that the described embodiments of the invention provide very effective jet propelled watercraft which permit the jet propulsion unit to be moved up to an out of the water position without interfering with the access or space of the rider's compartment and also without interfering with the effective operation of the jet propulsion unit. In addition, water cannot wash back into the operator's compartment due to the elevated center portion of the transom but the lowered side portions permit good rearward vision. In addition, the exhaust gases can freely flow from the engine or engines to the atmosphere regardless of whether the watercraft is operating in a forward or reverse direction without adverse effect on the hull. Of course, the foregoing description is that of preferred embodiments of the invention and various changes and modifications may be made without departing from the spirit and scope of the invention, as defined by the appended claims.

I claim:

1. A watercraft having a hull comprised of a lower hull portion and an upper deck portion, said hull defining a tunnel at the rear end thereof, a jet propulsion unit supported within said hull and at least in part in said tunnel for pivotal movement about a transverse, horizontal axis between a lowered drive position and a raised storage position, a powering internal combustion engine positioned forwardly of said tunnel and driving said jet propulsion unit, said tunnel being defined at its upper extremity by a first forward surface portion and a second rearward surface that is substantially higher above the remainder of the rear portion of the hull and which extends above the deck at the rear portion thereof and above said first forward surface and a third surface between said first forward surface and said second rearward surface and joining said first and second surfaces.

2. A watercraft as set forth in claim 1 wherein the rear end of the second rearward surface forms the upper end of an elevated transom portion disposed at the center of a pair of lower transom portions with the elevated transom portion lying above the discharge of the jet propulsion unit for precluding splash back of water into the interior of the watercraft during sudden decelerations.

3. A watercraft as set forth in claim 1 further including a passenger compartment formed at least in part above the tunnel and around the upper surface of the tunnel.

4. A watercraft as set forth in claim 3 wherein the rear end of the second rearward surface forms the upper end of an elevated transom portion disposed at the center of a pair of lower transom portions with the elevated transom portion lying above the discharge of the jet propulsion unit for precluding splash back of water into the interior of the watercraft during sudden decelerations.

5. A watercraft as set forth in claim 4 wherein the tunnel defines an area around said jet propulsion unit and within said hull where water from the body of water in which said watercraft is operating may enter and further including air vent means formed in the tunnel area at a point above the water level therein for precluding changes to the air pressure in said area due to changes in the water level.

6. A watercraft as set forth in claim 1 wherein the jet propulsion unit extends at least in part beyond the rear end of the tunnel when in its driving position, 7. A watercraft as set forth in claim 6 wherein the rear end of the second rearward surface forms the upper end of an elevated transom portion disposed at the center of a pair of lower transom portions with the elevated transom portion lying above the discharge of the jet propulsion unit for precluding splash back of water into the interior of the watercraft during sudden decelerations.

8. A watercraft as set forth in claim 6 further including a passenger compartment formed at least in part above the tunnel and around the upper surface of the tunnel.

9. A watercraft as set forth in claim 8 wherein the rear end of the second rearward surface forms the upper end of an elevated transom portion disposed at the center of a pair of lower transom portions with the elevated transom portion lying above the discharge of the jet propulsion unit for precluding splash back of water into the interior of the watercraft during sudden decelerations.

10. A watercraft as set forth in claim 9 wherein the tunnel defines an area around said jet propulsion unit and within said hull where water from the body of water in which said watercraft is operating may enter and further including air vent means formed in the tunnel area at a point above the water level therein for precluding changes to the air pressure in said area due to changes in the water level.

11. A watercraft having a hull defining a tunnel at the rear end thereof, a jet propulsion unit supported within said hull and at least in part in said tunnel for pivotal movement about a transverse, horizontal axis between a lowered drive position and a raised storage position, said tunnel being defined at its upper extremity by an upper surface that is substantially higher above the bottom of the hull at the rear thereof than at the front thereof, said tunnel being defined by a pair of spaced apart sidewalls and closed at its rear end by a transom of the hull which has an opening partially defined by said spaced apart sidewalls only in the vicinity of the drive position discharge of the jet propulsion unit, and a further pair of sidewalls formed by said hull only at the area of said transom and spaced apart a lesser distance than the first mentioned sidewalls and said opening.

12. A watercraft as set forth in claim 11 wherein the jet propulsion unit extends at least in part beyond the rear end of the tunnel when in its driving position.

13. A watercraft as set forth in claim 12 wherein the rear end of the upper surface forms the upper end of an elevated transom portion disposed at the center of a pair of lower transom portions with the elevated transom portion lying above the discharge of the jet propulsion unit for precluding splash back of water into the interior of the watercraft during sudden decelerations.

14. A watercraft as set forth in claim 12 further including a passenger compartment formed at least in part above the tunnel and around the upper surface of the tunnel.

15. A watercraft as set forth in claim 14 wherein the rear of the upper surface forms the upper end of an elevated transom portion disposed at the center of a pair of lower transom portions with the elevated transom portion lying above the discharge of the jet propulsion unit for precluding splash back of water into the interior of the watercraft during sudden decelerations.

16. A watercraft as set forth in claim 15 wherein the tunnel defines an area around said jet propulsion unit and within said hull where water from the body of water in which said watercraft is operating may enter and further including air vent means formed in the tunnel area at a point above the water level therein for precluding changes to the air pressure in said area due to changes in the water level.

17. A watercraft as set forth in claim 1 further including an engine compartment formed in the hull forwardly of the tunnel and driving the jet propulsion unit through a universal joint having its pivot axis aligned with the axis about which the jet propulsion unit pivots.

18. A watercraft as set forth in claim 17 further including exhaust conduit means for delivering exhaust gases from the engine for discharge to the atmosphere through the rear of the transom and adjacent the tunnel, said hull having an open recessed area adjacent the exhaust conduit termination and extending forwardly thereof for permitting exhaust gases to flow forwardly of the hull when the watercraft is traveling in a reverse direction.

19. A watercraft as set forth in claim 18 wherein the tunnel is defined by a pair of spaced apart sidewalls and is closed at its rear end by a transom of the hull which is open only in the vicinity of the discharge of the jet propulsion unit and wherein the opening is defined by a further pair of sidewalls spaced apart a lesser distance than the first mentioned sidewalls.

20. A watercraft as set forth in claim 19 wherein the jet propulsion unit extends at least in part beyond the rear end of the tunnel when in its driving position.

21. A watercraft as set forth in claim 20 wherein the portion of the hull defining the tunnel describes an elevated transom portion disposed at the center of a pair of lower portions with the elevated transom portion lying above the discharge of the jet propulsion unit for precluding splash back of water into the interior of the watercraft during sudden decelerations.

22. A watercraft as set forth in claim 20 further including a passenger compartment formed at least in part above the tunnel and around the upper surface of the tunnel.

23. A watercraft as set forth in claim 22 wherein the portion of the hull defining the tunnel describes an elevated transom portion disposed at the center of a pair of lower portions with the elevated transom portion lying above the discharge of the jet propulsion unit for precluding splash back of water into the interior of the watercraft during sudden decelerations.

24. A watercraft as set forth in claim 23 wherein the tunnel defines an area around said jet propulsion unit and within said hull where water from the body of water in which said watercraft is operating may enter and further including air vent means formed in the tunnel area at a point above the water level therein for precluding changes to the air pressure in said area due to changes in the water level.

25. A watercraft having a hull defining a tunnel closed at least in part at the rear end thereof by a transom having a opening, a jet propulsion unit supported within said hull for movement between a drive position at least in part in said tunnel and an elevated position entirely within said tunnel, said jet propulsion unit having a discharge nozzle which extends at least in part through said transom opening, a reverse thrust bucket supported at the end of said discharge nozzle for generating reverse thrust forces, said reverse thrust bucket extending to the rear of said transom opening when in its drive position.

26. A watercraft having a hull defining a tunnel at the rear end thereof, a jet propulsion unit supported within said hull and at least in part in said tunnel, an engine compartment formed within said hull forwardly of said jet propulsion unit and driving said jet propulsion unit, exhaust conduit means extending from said engine through said hull along one side of said tunnel and exiting through a transom opening of said hull, the portion of said transom through which said exhaust conduit means exits being disposed at an angle to the rear of said watercraft, said transom portion diverging forwardly relative to a longitudinal center line of the hull to the side of said hull so as to define a portion that extends forwardly, exhaust gases exiting through and flowing forwardly along said transom portion upon rearward movement of the watercraft in a body of water in which it is operating.

27. A watercraft as set forth in claim 26 wherein the hull transom angular portion is formed by an unrestricted recess adjacent the transom opening through which the exhaust gases exit and which extends forwardly from the rear end of said exhaust conduit means.

* * * * *